US008590716B2

(12) United States Patent
Behjat

(10) Patent No.: US 8,590,716 B2
(45) Date of Patent: Nov. 26, 2013

(54) DRYING RACK WITH WRAP-AROUND COVER

(76) Inventor: Mohammad Kazem Behjat, Las Vegas, NV (US)

( * ) Notice: Subject to any disclaimer, the term of this patent is extended or adjusted under 35 U.S.C. 154(b) by 155 days.

(21) Appl. No.: 12/798,943

(22) Filed: Apr. 14, 2010

(65) Prior Publication Data

US 2011/0253651 A1 Oct. 20, 2011

(51) Int. Cl.
*A47B 43/00* (2006.01)

(52) U.S. Cl.
USPC ..... 211/195; 211/198; 211/203

(58) Field of Classification Search
USPC ..... 211/149, 150, 186, 188, 153, 198, 195, 211/201, 196, 169, 169.1, 170; 108/115, 108/99, 162, 163, 166, 167, 169, 173, 174
See application file for complete search history.

(56) References Cited

U.S. PATENT DOCUMENTS

| | | | | | |
|---|---|---|---|---|---|
| 151,037 | A * | 5/1874 | Magee | 211/99 |
| 284,286 | A * | 9/1883 | Downing | 211/171 |
| 351,300 | A * | 10/1886 | Waterman | 211/170 |
| 391,191 | A * | 10/1888 | Ritterhouse | 211/198 |
| 444,815 | A * | 1/1891 | Casler | 211/173 |
| 1,167,550 | A * | 1/1916 | Forsyth | 108/163 |
| 1,198,431 | A * | 9/1916 | Forsyth | 108/163 |
| 1,304,847 | A * | 5/1919 | Blais et al. | 108/163 |
| 1,599,083 | A * | 9/1926 | Gagne | 211/198 |
| 1,779,788 | A * | 10/1930 | Weston | 211/130.1 |
| 1,984,827 | A * | 12/1934 | Derman | 312/4 |
| 2,085,983 | A * | 7/1937 | Jordan | 211/85 |
| 2,119,442 | A * | 5/1938 | Robinson | 108/99 |
| 2,353,374 | A * | 7/1944 | Thompson | 211/170 |
| 2,356,930 | A * | 8/1944 | Horstkotte | 211/170 |
| 2,883,064 | A * | 4/1959 | McKenzie | 108/99 |
| 5,131,547 | A * | 7/1992 | Goldberg | 211/149 |
| 5,816,419 | A * | 10/1998 | Lamson | 211/150 |
| 6,021,916 | A * | 2/2000 | Stolzman | 220/675 |
| 6,105,804 | A * | 8/2000 | Stoffer | 220/9.4 |
| 6,341,713 | B1 * | 1/2002 | Kilmer | 220/694 |
| 6,508,282 | B2 * | 1/2003 | Garofalo et al. | 150/154 |
| 6,543,864 | B2 * | 4/2003 | Cline | 312/3 |
| 7,077,251 | B1 * | 7/2006 | Gaither | 190/26 |
| 2006/0010783 | A1 * | 1/2006 | Evans | 52/3 |
| 2007/0012638 | A1 * | 1/2007 | Van Eijk | 211/104 |
| 2007/0079548 | A1 * | 4/2007 | Bakowski | 47/31 |
| 2008/0163965 | A1 * | 7/2008 | McNelly | 150/165 |
| 2009/0211993 | A1 * | 8/2009 | Chiang et al. | 211/37 |
| 2011/0017104 | A1 * | 1/2011 | DiTrolio | 108/50.11 |

* cited by examiner

*Primary Examiner* — Joshua J Michener
*Assistant Examiner* — Devin Barnett
(74) *Attorney, Agent, or Firm* — Michael P. Artemis

(57) ABSTRACT

A drying rack having a wrap-around cover includes a support frame having at least one support member, an upper shelf, an intermediate shelf and a lower shelf. The shelves are spaced apart from each other and provide a stacked surface area for drying clothes, linens, garments and other textiles. The drying rack further includes a wrap-around cover that attaches to the upper shelf and extends towards the lower shelf. The cover may be fabricated from a heat absorptive material and may further include graphical designs for visual appeal.

20 Claims, 5 Drawing Sheets

DRYING RACK WITH WRAP-AROUND COVER

FIELD OF THE INVENTION

This invention relates to outdoor drying racks used to air dry clothes, towels, garments and other damp or wet textiles. More particularly, this invention relates to an outdoor drying rack that includes a wrap-around cover that facilitates drying.

BACKGROUND OF THE INVENTION

A common task in daily living is that of washing and drying clothes, towels, linens, garments and other textiles. Most people use automated machines such as a washer and dryer to reduce the time necessary to perform this task. However, there still exists a need to air dry particular items instead of using a drying machine. A person may choose to air dry particular items for several reasons such as: to save energy costs, to reduce garment wear, or to abide by garment care instructions.

The most common way to air dry laundry items is to hang the items from a clothesline in an outdoor area such as a backyard. However, this drying technique is disadvantageous for several reasons. First, due to the common construction of known backyard clotheslines a considerable amount of space is required to hang wet laundry items for drying. Additionally, for people living in apartments or condominiums, there simply may not be enough space on a porch or balcony for a clothesline. Second, drying clothes and textiles in open air and directly exposed to sunlight frequently causes color fading and UV damage. Third, merely hanging a wet textile on a clothesline takes a considerable amount of time to dry, especially if there is little to no airflow around the items. Such as on a calm day with no breeze. Fourth, the items frequently dry in a manner that leaves the garments stiff and rough to the touch. Finally, having clothes, towels, linens, and other garments open to public view is not visually appealing. Moreover, hanging these items in public view may be in violation of various housing rules imposed by governing organizations such as homeowners associations and may result in fines and penalties.

Efforts to provide a drying rack that are devoid of the above-noted disadvantages have not met with success to date.

SUMMARY OF THE INVENTION

The present invention generally comprises a drying rack having a wrap-around cover which is devoid of the above-noted disadvantages and which substantially facilitates the drying process.

In one aspect, the invention provides a drying rack having a support frame, an upper shelf, a lower shelf, an intermediate shelf and a cover. The support frame includes at least one support member having a first end and an opposing second end. The upper shelf is pivotally coupled to the at least one support member adjacent an upper portion of the drying rack, where the upper portion is substantially adjacent the second end of the support member. The lower shelf is pivotally coupled to the at least one support member adjacent a lower portion of the drying rack, where the lower portion is substantially adjacent the first end of the support member. The lower shelf is spaced apart from the upper shelf. There is at least one intermediate shelf pivotally coupled to the at least one support member and positioned between the upper shelf and the lower shelf. The cover has a top edge, an opposing bottom edge, an outwardly facing surface and an opposing inwardly facing surface. The top edge of the cover is releasably coupled to a perimeter edge of the upper shelf and the bottom edge of the cover is positioned adjacent to the lower shelf. An internal volumetric space is defined by the inwardly facing surface of the cover as the cover wraps-around the drying rack.

In another aspect, the invention provides a drying system having a drying rack and a wrap-around cover. The drying rack has a support frame, an upper shelf, a lower shelf, an intermediate shelf and a cover. The support frame includes at least one support member having a first end and an opposing second end. The upper shelf is pivotally coupled to the at least one support member adjacent an upper portion of the drying rack, where the upper portion is substantially adjacent the second end of the support member. The lower shelf is pivotally coupled to the at least one support member adjacent a lower portion of the drying rack, where the lower portion is substantially adjacent the first end of the support member. The lower shelf is spaced apart from the upper shelf. There is at least one intermediate shelf pivotally coupled to the at least one support member and positioned between the upper shelf and the lower shelf. The cover has a top edge, an opposing bottom edge, an outwardly facing surface and an opposing inwardly facing surface. The top edge of the cover is releasably coupled to a perimeter edge of the upper shelf and the bottom edge of the cover is positioned adjacent to the lower shelf. An internal volumetric space is defined by the inwardly facing surface of the cover as the cover wraps-around the drying rack.

In other various aspects, the invention provides a drying rack and wrap-around cover that further includes several additional enhancements. First, the drying rack may include spaced-apart shelf slats coupled to the upper, intermediate and lower shelves. Second, the drying rack may include at least one vertical rack having a plurality of slats. The vertical rack pivotally coupled to the intermediate shelf such that the vertical rack extends between the intermediate and upper shelves. There may also be a vertical rack pivotally coupled to the lower shelf such that the vertical rack extends between the lower and intermediate shelves. Third, the cover may be fabricated from a heat absorptive material and have graphical designs applied upon the outwardly facing surface. Fourth, the drying rack includes an air exhaust and an air intake such that air intake is larger in cross-sectional area than the air exhaust. Finally, the drying rack includes a support frame that may be anchored to a ground surface and is configured to expand from a collapsed state to an expanded state, such that when the support frame is in a collapsed state the upper, intermediate and lower shelves are substantially co-planer.

For a fuller understanding of the nature and advantages of the present invention, reference should be made to the ensuing detailed description and claims, taken in conjunction with the accompanying drawings.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE PREFERRED EMBODIMENTS

The present invention relates to a drying rack which includes a wrap-around cover. In the following description, numerous specific details are set forth in order to provide a more thorough description of the present invention. It will be apparent, however, to one skilled in the art, that the present invention may be practiced without these specific details. In other instances, well-known features and processes have been indicated although not described in detail so as not to obscure the invention.

Figure 1:
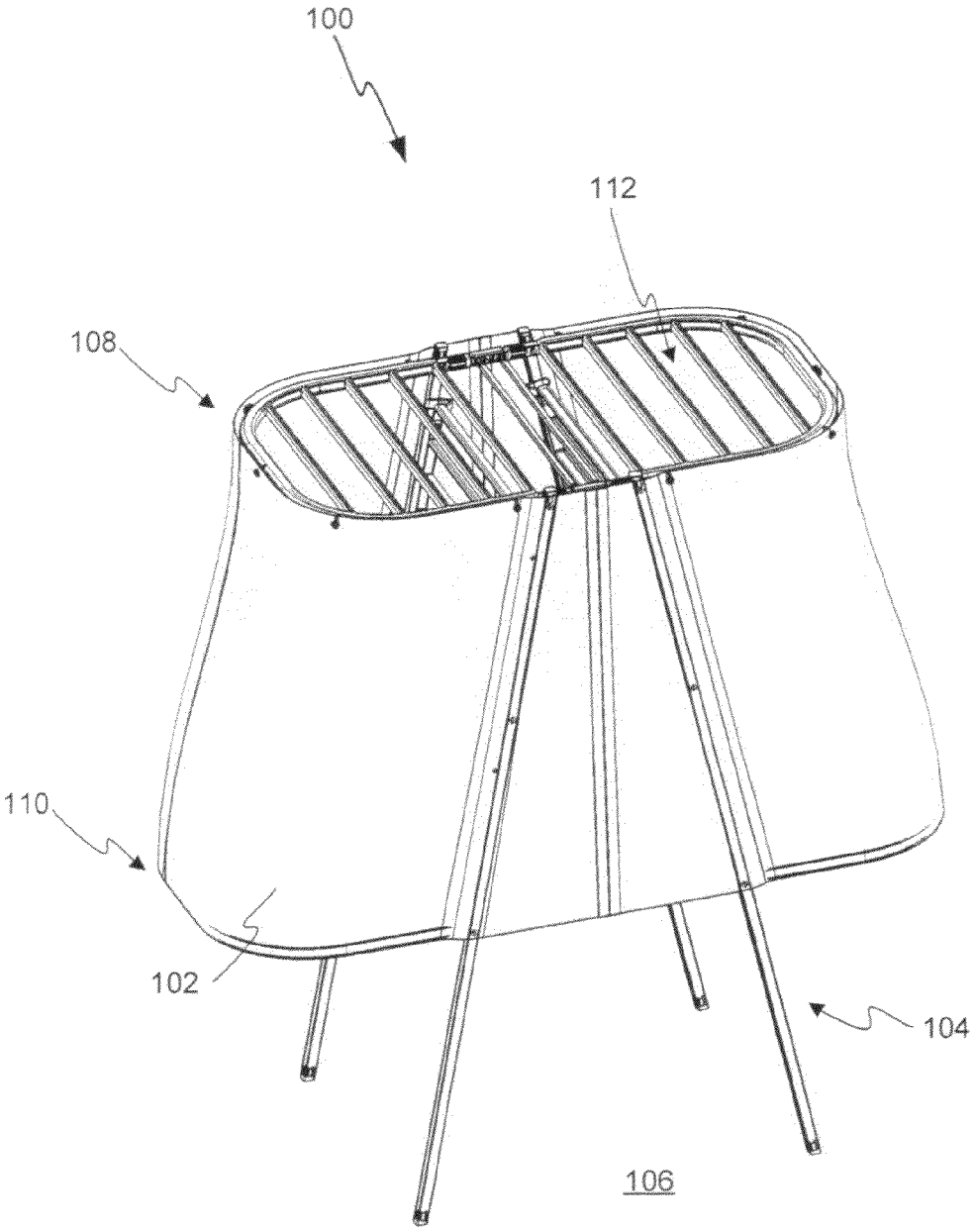
FIG. 1 is a perspective view of a drying rack including a wrap-around cover.

Referring to the figures, FIG. 1 shows one exemplary embodiment of a drying rack 100 including a wrap-around cover 102. Drying rack 100 is supported by a support frame 104 that is in contact with a ground surface 106. Cover 102 extends from an upper portion 108 to a lower portion 110 of drying rack 100. As cover 102 wraps-around drying rack 100, it defines an internal volumetric space 112

Figure 2:
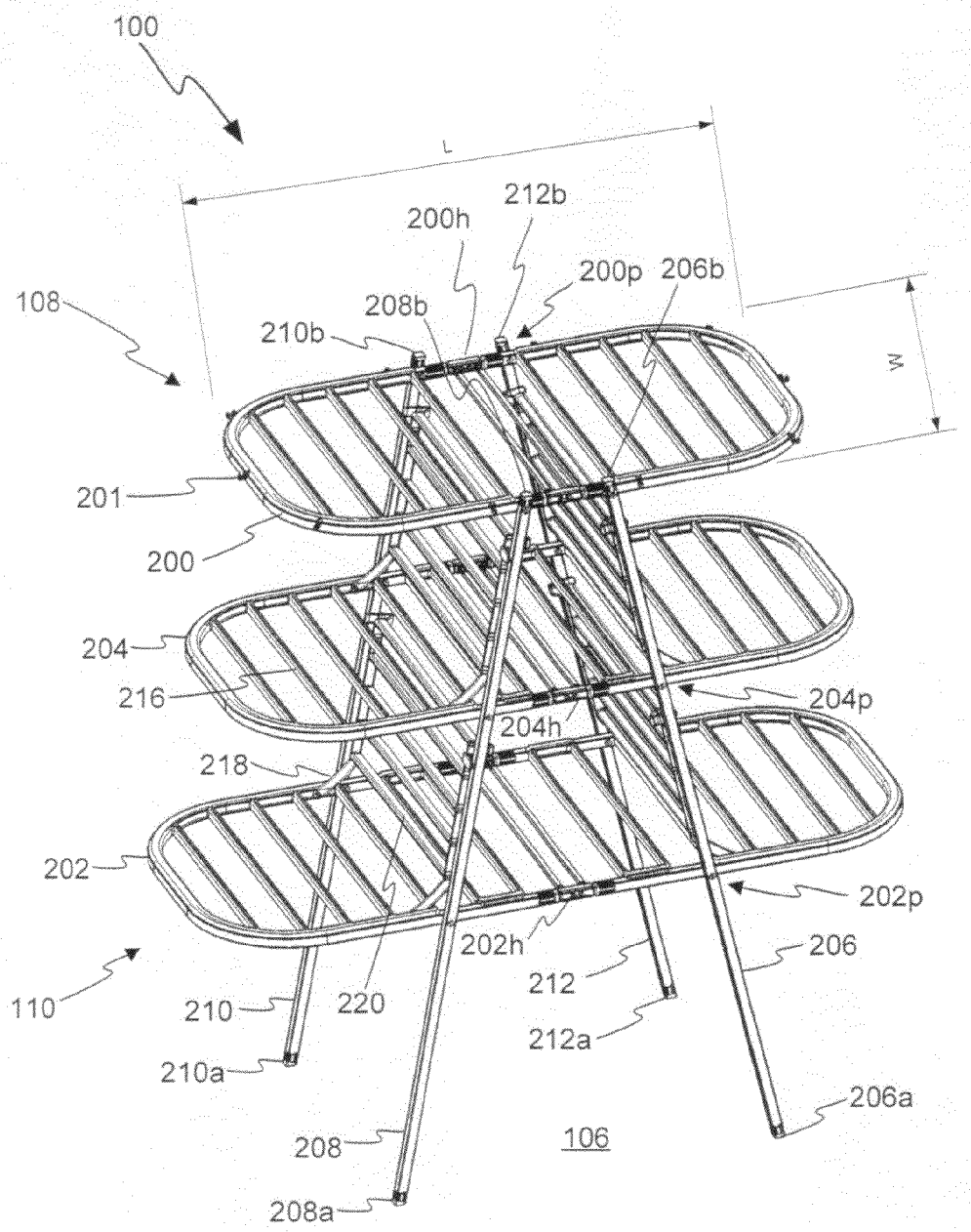
FIG. 2 is a perspective view of the drying rack of FIG. 1 with the wrap-around cover removed.

FIG. 2 is a perspective view of the drying rack 100 of FIG. 1 with the wrap-around cover 102 removed. Drying rack 100 has an upper shelf 200 located adjacent to upper portion 108 and a lower shelf 202 spaced apart by about 40" from upper shelf 200. Upper shelf 200 further comprises a plurality of hooks 201 that extend radially outward from shelf 200. Hooks 201 are positioned around a perimeter edge of upper shelf 200 and configured to releasably retain wrap-around cover 102. An intermediate shelf 204 is positioned between upper and lower shelves 200 and 202. Alternative embodiments are contemplated that comprise a plurality of intermediate shelves that are positioned between upper and lower shelves 200, 202. Shelves 200, 202 and 204 are structurally supported by frame 104. In an exemplary embodiment, frame 104 comprises four support members 206, 208, 210, and 212 to thereby form an A-frame structure when in an expanded state. Support members 206, 208, 210, and 212 generally extend from first ends 206*a*, 208*a*, 210*a*, and 212*a* that are in supportive contact with a ground surface 106 towards opposite second ends 206*b*, 208*b*, 210*b*, and 212*b* which are pivotally coupled with upper shelf 200. It is contemplated that first ends 206*a*, 208*a*, 210*a*, and 212*a* may be anchored to ground surface 106 by mechanical fasteners such as bolts, screws, and/or ground steaks. In alternative embodiments, frame 104 may comprise fewer than four support members.

Shelves 200, 202, and 204 each comprise a generally rectangular two-piece frame hinged at respective center points 200*h*, 202*h*, 204*h* and pivotally coupled to support members 206, 208, 210, and 212 at pivot points 200*p*, 202*p*, 204*p* adjacent to center points 200*h*, 202*h*, 204*h*. As will be apparent to those of ordinary skill in the art, the actual location of pivot points 200*p*, 202*p*, 204*p* may be empirically determined. It is contemplated that each shelf hinge located at center points 200*h*, 202*h*, 204*h* be configured to lock and retain the respective shelf in a horizontal position when drying rack 100 is in an expanded state (described in greater detail below). In an exemplary embodiment, shelves 200, 202, and 204 increase in size from the upper shelf 200 to the lower shelf 202 to thereby define a generally taper-shaped drying rack 100. For example, upper shelf 200 may have an approximate width "W" and length "L" of about 30" by 50", intermediate shelf 204 may have an approximate width "W" and length "L" of about 30" by 60", and lower shelf 202 may have an approximate width "W" and length "L" of about 30" by 70" In an alternate embodiment, the perimeter profile shape of shelves 200, 202, and 204 may be circular, oval, square or other geometric configuration.

A plurality of shelf slats 216 are coupled with shelves 200, 202, and 204 and extend across a width "W" of each respective shelf. Slats 216 are generally spaced about 3" apart and may be press-fit, welded, bolted or formed as an injection molded piece coupled with the shelf frame. Shelf slats 216 provide structure from which to hang clothes, linens, garments or other textiles for drying. In alternate embodiments, one or more slats may be replaced with a structure such as a perforated plate or netting (not shown) for holding small items such as socks, handkerchiefs and the like.

In an exemplary embodiment, a vertical rack 218 is pivotally coupled to lower shelf 202. A plurality of slats 220 are coupled with vertical rack 218 and extend across a width "W" thereof. Slats 220 are generally spaced about 3" apart and may be press-fit, welded, bolted or formed as an injection molded piece coupled with the vertical rack 218. Vertical rack 218 is shown in FIG. 2 in a fully deployed state that extends vertically between shelves 202 and 204. In an exemplary embodiment, drying rack 100 includes vertical racks 218 that extend between the lower and intermediate shelves 202, 204 as well as between the intermediate and upper shelves 204, 200.

The presently preferred method of fabricating shelves 200, 202, 204 is by bending tubular stock to form a U-Shaped frame. Alternatively, the shelves 200, 202, 204 and frame 104 may be formed by other well known manufacturing processes. Some examples of various processes are: injection molding, thermal forming, vacuum forming, composite lay-up, casting, extrusion or machining. These manufacturing processes are well known and not described in detail so as not to obscure the invention.

Figure 3:
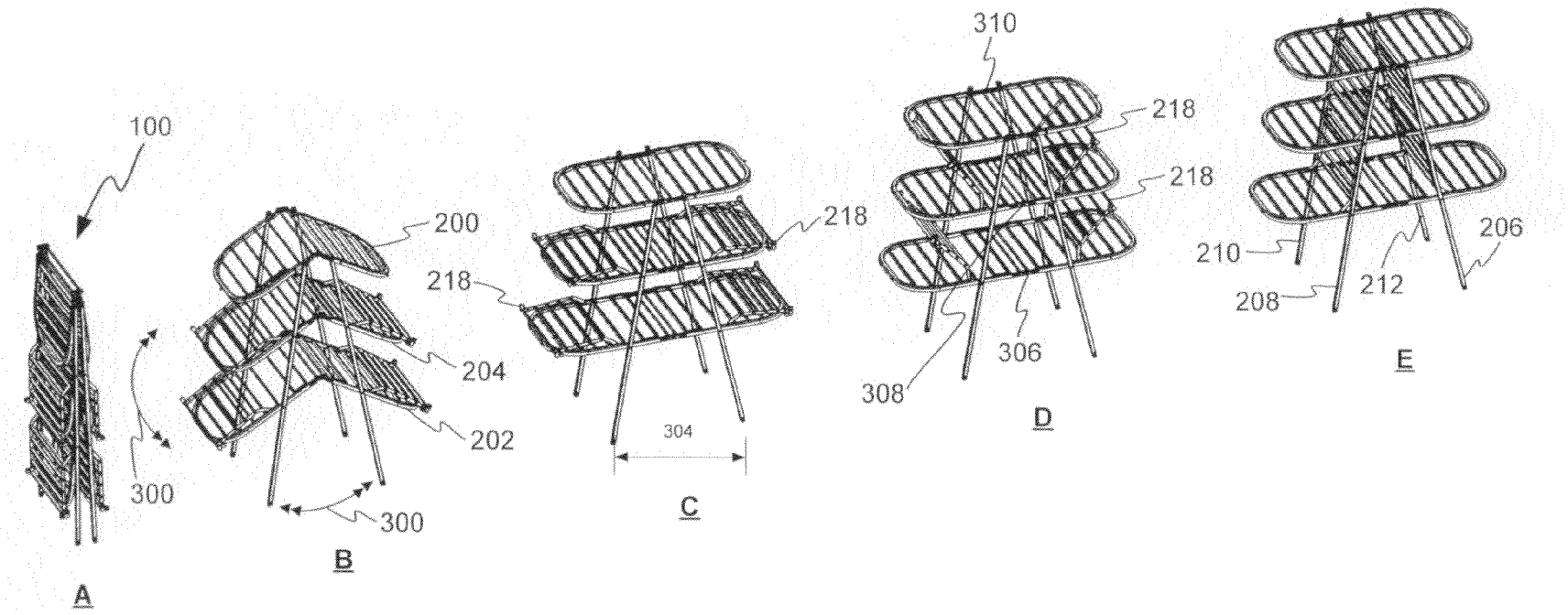
FIG. 3 is a perspective view, 5-stage transformation illustrating the deployment of the drying rack from a collapsed state to an expanded state.

Reference is now made to FIG. 3 which illustrates a 5-stage transformation showing the deployment of the drying rack 100 from a collapsed state "A" to an expanded state "E". In collapsed state "A" the support members 206, 208, 210 and 212 are close together and the shelves 200, 202, 204 and rack 218 are in a folded down position. As the support members 206, 208, 210 and 212 are spread apart 300, shelves 200, 202, and 204 arc upwards 302 as shown in partially expanded state "B". Upon separating support members 206, 208, 210 and 212 to there maximum distance 304, shelves 200, 202, and 204 are locked into a horizontal position by hinges 306, 308, and 310 as shown in fully expanded state "C". In expansion state "C", vertical racks 218 are not yet deployed but are individually positioned by pivoting vertical racks 218 as illustrated in state "D" until they engage support members 206, 208, 210 and 212. Once vertical racks 218 are pivoted into position as illustrated in state "E", racks 218 are releasably retained with respect to support members 206, 208, 210 and 212 by use of retention clips, snaps, or other mechanical coupling means.

Figure 4:
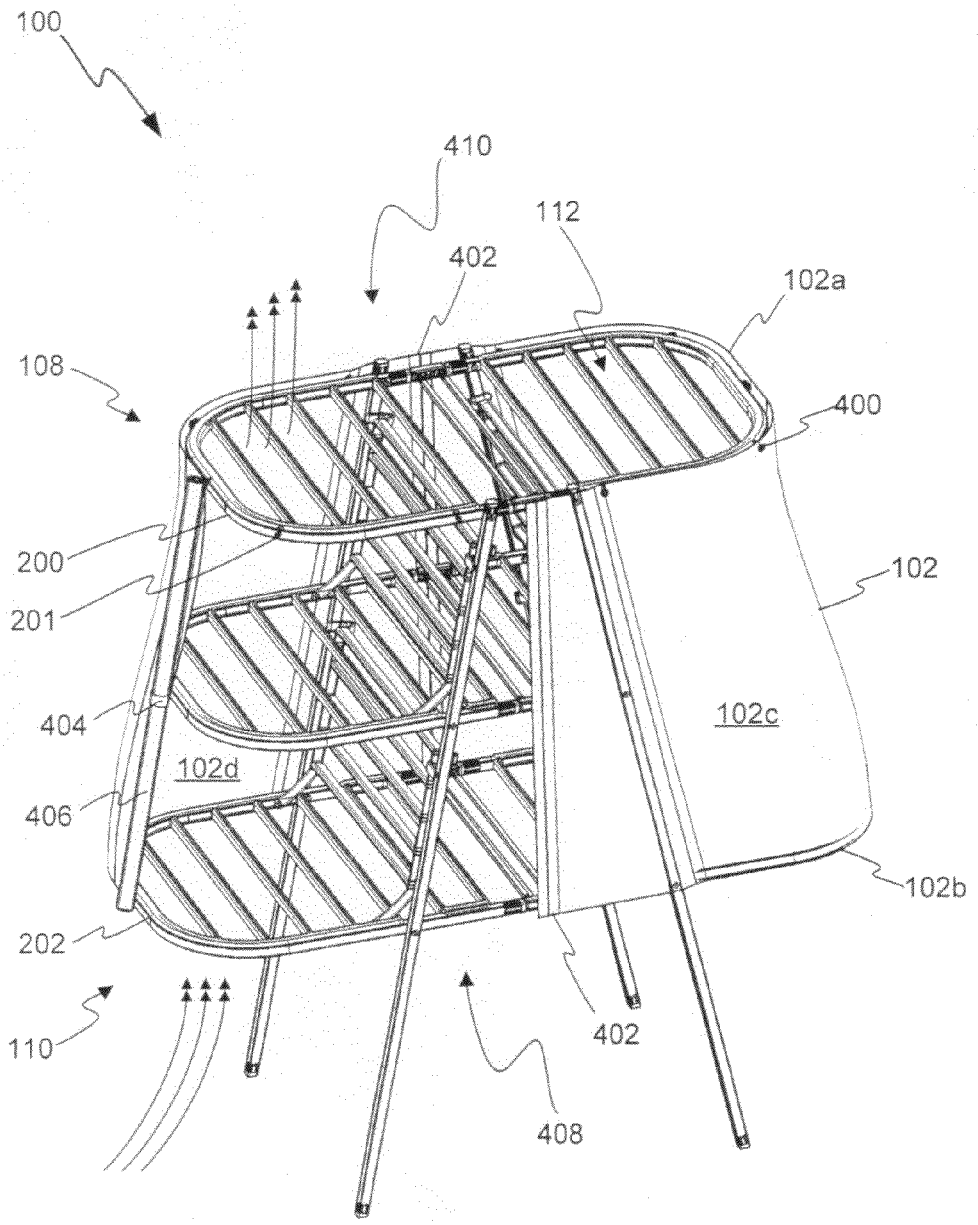
FIG. 4 is a perspective view of the drying rack of FIG. 1 with a portion of the wrap-around cover rolled back.

Reference is now made to FIG. 4, which illustrates drying rack 100 with a portion of the wrap-around cover 102 rolled back. Cover 102 has a top edge 102*a*, a bottom edge 102*b*, an outwardly facing surface 102*c* and an inwardly facing surface 102*d*. Cover 102 has a plurality of grommet reinforced holes 400 positioned around and located adjacent to top edge 102*a*.

Grommet reinforced holes 400 are sized and spaced to releasably engage hooks 201 of upper shelf 200. Alternatively, it is contemplated that top edge 102*a* may be releasably coupled with upper shelf 200 by other mechanical fastening means such as hook and loop fasteners, snaps, clips, or combinations thereof. Cover 102 extends from upper shelf 200 to lower shelf 202 and thereby defines an interior volumetric space 112 within drying rack 100. In one exemplary embodiment, cover 102 is a multi-piece cover having a pair of seams 402. Seams 402 are fitted with hook and loop fasteners to facilitate releasably coupling together the multi-piece cover 102. Alternatively, seams 402 may be fitted with other mechanical fasteners such as a zipper, buttons, snaps or clips, to provide releasable coupling there between. Cover 102 further comprises at least one retention strap 404 to secure a rolled-up portion 406 of cover 102 to facilitate loading and unloading of clothes, linens and other textiles from drying rack 100.

An alternate embodiment provides cover 102 that has a lower edge 102*b* that extends below lower shelf 202 such that a lower skirt (not shown) is formed that facilitates air flow into the interior volumetric space 112. In another alternative embodiment, cover 102 includes an upper edge 102*a* that extends above upper shelf 200 such that an upper collar (not shown) is formed that facilitates air flow out of the interior volumetric space 112. Additionally, outwardly facing surface 102*c*, may have various graphic and visually appealing designs applied thereon. For example, the outwardly facing surface 102*c* may have scenic, floral, abstract, color gradient, symbols, emblems, logos or other artistic designs applied to surface 102*c*. It is contemplated that these artistic designs be printed, painted, embroidered or silk-screened directly to surface 102*c*. Alternatively, the artistic designs may be applied to a secondary piece of fabric which is then coupled (such as by sewing or gluing) to outwardly facing surface 102*c*. In one alternative embodiment, outwardly facing surface 102*c* has a color gradient progressing from dark to light, in which the dark portion is adjacent to lower shelf 202 and transition to a light portion adjacent to upper shelf 200. This color scheme of dark-to-light color gradient facilitates air flow within the interior volumetric space 112 of drying rack 100.

In one exemplary embodiment, cover 102 is preferably fabricated from a heat absorptive and UV resistant high density polyethylene (HDPE) plastic fabric. A characteristic of HDPE plastic fabric is the ability to absorb solar energy and convert solar energy to heat energy. HDPE plastic fabric is commonly referred to as a solar heating drape which absorbs solar energy and redirects this solar energy into an adjacent area in the form of radiative heat. One suitable choice for HDPE plastic fabric is a solar heating drape code "CDSH-DLG" available from BetterEarthProducts.com of San Diego, Calif. In an alternate exemplary embodiment, cover 102 may be fabricated from materials such as canvas, nylon, polyester or other known textiles which thereby form a wrap-around cover.

Reference is now made to both FIGS. 1 and 4 in combination. In FIG. 1, when cover 102 is fully installed around drying rack 100, an air intake 408 is formed at the lower portion 110 and an air exhaust 410 is formed at the upper portion 108 of the drying rack. In one exemplary embodiment, air flow (designated by the double arrow lines in FIG. 4) through the internal volumetric space 112 of drying rack 100 is induced due to the cross-sectional area of air exhaust 410 being smaller than the cross-sectional area of air intake 408.

Figure 7:
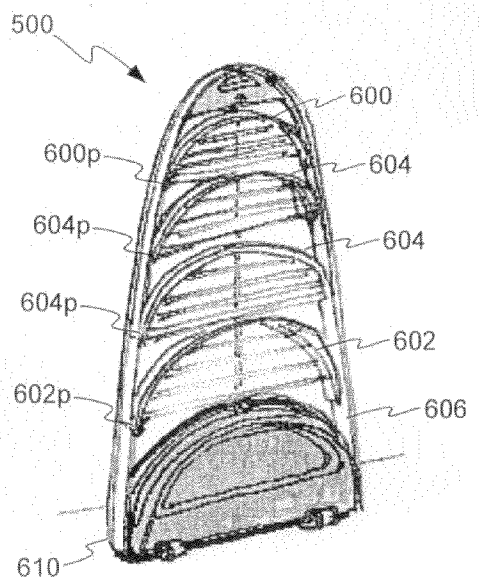
FIG. 7 is a perspective view, of the drying rack of FIG. 6 illustrating the drying rack in a collapsed state.
Figure 6:
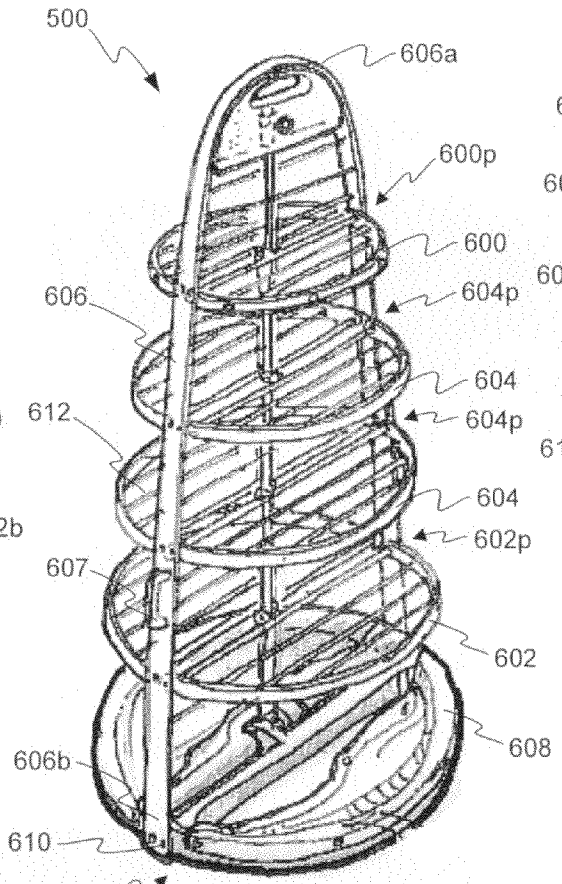
FIG. 6 is a perspective view of the drying rack of FIG. 5 with the wrap-around cover removed.
Figure 5:
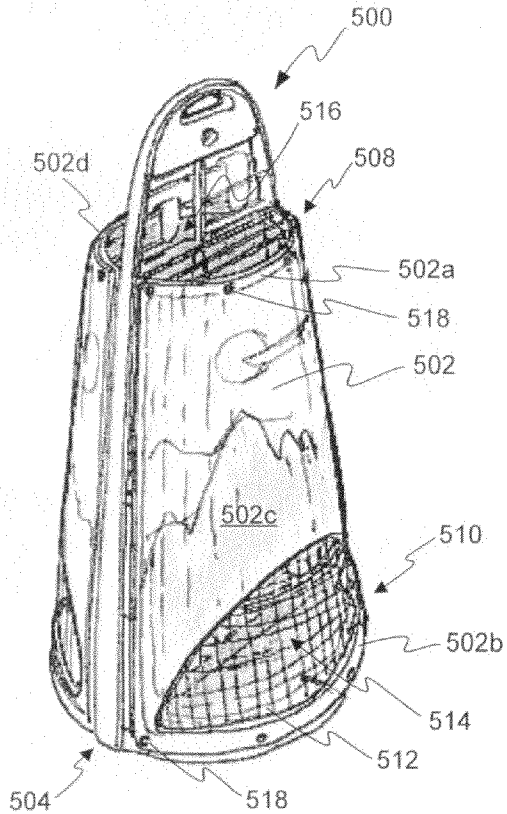
FIG. 5 is a perspective view of an alternate embodiment of a drying rack including a wrap-around cover.

An alternate embodiment of the present invention is illustrated in FIGS. 5-7, in which the drying rack has a generally conical shape. As shown in FIG. 5, a drying rack 500 includes a wrap-around cover 502. Drying rack 500 is supported by a support frame 504 that forms an upper portion 508 and a lower portion 510. Support frame 504 tappers from the wider lower portion 510 towards a smaller upper portion 508. Cover 502 extends from upper portion 508 to a lower portion 510 of drying rack 500. As cover 502 wraps-around drying rack 500, it defines an internal volumetric space 512. Cover 502 has a top edge 502*a*, a bottom edge 502*b*, an outwardly facing surface 502*c* and an opposite inwardly facing surface 502*d*. Cover 502 has a plurality of snaps 518 positioned around and located adjacent to top edge 502*a* and 502*b* to releasably retain cover 502 to drying rack 500. Alternatively, it is contemplated that cover 502 may be releasably coupled with drying rack 500 by other mechanical fastening means such as hook and loop fasteners, snaps, clips, or combinations thereof.

Additionally, outwardly facing surface 502*c*, may have various graphic and visually appealing designs applied thereon. For example, the outwardly facing surface 502*c* may have scenic, floral, abstract, color gradient, symbols, emblems, logos or other artistic designs applied to surface 502*c*. It is contemplated that these artistic designs be printed, painted, embroidered or silk-screened directly to surface 502*c*. Alternatively, the artistic designs may be applied to a secondary piece of fabric which is then coupled (such as by sewing or gluing) to outwardly facing surface 502*c*. In one alternative embodiment, outwardly facing surface 502*c* has a color gradient progressing from dark to light, in which the dark portion is adjacent to lower portion 510 and transition to a light portion adjacent to upper portion 508. This color scheme of dark-to-light color gradient facilitates air flow within the interior volumetric space 512 of drying rack 500.

In this exemplary embodiment, cover 502 is preferably fabricated from a heat absorptive and UV resistant high density polyethylene (HDPE) plastic fabric. A characteristic of HDPE plastic fabric is the ability to absorb solar energy and convert solar energy to heat energy. HDPE plastic fabric is commonly referred to as a solar heating drape which absorbs solar energy and redirects this solar energy into an adjacent area in the form of radiative heat. One suitable choice for HDPE plastic fabric is a solar heating drape code "CDSH-DLG" available from BetterEarthProducts.com of San Diego, Calif. In an alternate exemplary embodiment, cover 502 may be fabricated from materials such as canvas, nylon, polyester or other known textiles which thereby form a wrap-around cover.

An air intake 514 is formed at the lower portion 510 and an air exhaust 516 is formed at the upper portion 508 of the drying rack 500. In one exemplary embodiment, in order to facilitate air flow through the internal volumetric space 512 of drying rack 500, the cross-sectional area of air exhaust 561 is smaller than the cross-sectional area of air intake 514.

FIG. 6 is a perspective view of the drying rack 500 of FIG. 5 with the wrap-around cover 502 removed. Drying rack 500 has an upper shelf 600 located adjacent to upper portion 508 and a lower shelf 602 spaced apart from upper shelf 600. The spacing between shelves should be sufficient to provide for adequate clearance when the shelves are pivoted when the drying rack 500 is put into a collapsed state as shown in FIG. 7. Upper shelf 600 further comprises a plurality of snaps 518 that extend radially outward from shelf 600. Snaps 518 are positioned around a perimeter edge of upper shelf 600 and configured to releasably retain wrap-around cover 502. A plurality of intermediate shelves 604 are positioned between upper and lower shelves 600 and 602. Shelves 600, 602 and 604 are structurally supported by frame 504. In this alternate embodiment, frame 504 comprises a central support member 606 that extends generally perpendicularly from a base member 608. Central support member 606 has a first end 606*a*, an opposite second end 606*b*, and a handle portion 607. Second end 606*b* is mechanically coupled to base member 608 by one or more base member pivot points 610 such that base member 608 may fold in half. Alternatively, base member 608 may be a fixed member coupled with second end 606*b* by mechanical fasteners such as bolts, screws, rivets or adhesives. It is contemplated that base member 608 may be anchored to the ground by mechanical fasteners such as bolts, screws, and/or ground steaks.

Shelves 600, 602, and 604 each comprise a generally circular two-piece frame hinged at respective shelf pivot points 600*p*, 602*p*, 604*p* and pivotally coupled to central support member 606. It is contemplated that each shelf pivot points 600*p*, 602*p*, 604*p* comprise a mechanical such as pin or other structural feature coupled therewith such that the respective shelf may be locked and retained in a horizontal position when drying rack 500 is in an expanded state. In an exemplary embodiment, shelves 600, 602, and 604 increase in size from the upper shelf 600 to the lower shelf 602 to thereby define a generally conical-shaped drying rack 500. For example, upper shelf 600 may have an approximate diameter of about 12"-18", intermediate shelves 604 may have approximate diameters of about 18"-28", and lower shelf 602 may have an approximate diameter of about 28"-36". In an alternate embodiment, the perimeter profile shape of shelves 600, 602, and 604 may be circular, oval, square or other geometric configuration.

A plurality of shelf slats 612 are coupled with shelves 600, 602, and 604 and extend across of each respective shelf. Slats 612 are generally spaced about 3" apart and may be press-fit, welded, bolted or formed as an injection molded piece coupled with the shelf frame. Shelf slats 612 provide structure from which to hang clothes, linens, garments or other textiles for drying. In alternate embodiments, one or more slats may be replaced with a structure such as a perforated plate or netting (not shown) for holding small items such as socks, handkerchiefs and the like.

The presently preferred method of fabricating shelves 600, 602, 604 is by bending tubular stock to form a C-Shaped frame. Alternatively, the shelves 600, 602, 604 and central support member 606 may be formed by other well known manufacturing processes. Some examples of various processes are: injection molding, thermal forming, vacuum forming, composite lay-up, casting, extrusion or machining. These manufacturing processes are well known and not described in detail so as not to obscure the invention.

Illustrated in FIG. 7 is a perspective view, of the drying rack 500 in a collapsed state. In this collapsed state, shelves 600, 602, and 604 are pivoted about shelf pivot points 600*h*, 602*h*, and 604*h* such that shelves 600, 602, 604 are substantially co-planer with central support member 606. Additionally, base member 608 is also pivoted about base member pivot point such that base member 608 is substantially co-planer with central support member 606. The collapsed state provides for convenient storage of drying rack 500.

In operation, the drying is deployed from a collapsed state to an expanded state with respect to the two exemplary embodiments as describe above. Once the drying rack is deployed, the wrap-around cover is installed by coupling the top edge of the cover to the upper shelf of the drying rack. Upon completion of installing the cover, the drying rack is ready for use by placing damp/wet clothes, towels, linens, garments or other textiles on the slats of the drying rack shelves. In use, drying is facilitated by the cover absorbing solar energy and then radiating this solar energy in the form of heat energy into the interior volumetric space of the drying rack. As the cover radiates this heat energy, the temperature of the air within the interior volumetric space increases. The heated air then rises and is exhausted through the an air exhaust formed by the upper portion of the drying rack. In response to the heated air rising, cooler air is drawn into the interior volumetric space through the air inlet formed by the lower portion of the drying rack, thereby inducing a dynamic airflow within the interior volumetric space of the drying rack. As a result of the induced dynamic airflow, heat and mass transfer rates are substantially increased within the drying rack which facilitates drying of damp/wet clothes, towels, garments and other textiles. In one experiment, there was a twenty degree temperature increase of the interior volumetric space as compared to a surrounding ambient temperature.

The drying rack disclosed herein provides several advantages not found in known outdoor/backyard drying systems or clotheslines. Firstly, the invention provides a compact drying rack having a reduced footprint due to the vertical stacking of the shelves, thus the drying rack does not require a considerable amount of floor space for drying clothes, linens, towels, and other textiles. The vertical configuration of the drying rack is most beneficial for people living in apartments or condominiums, where there simply may not be enough space on a porch or balcony for a traditional clothesline. Secondly, the invention reduces the chances of damage to clothes and textiles caused by direct sunlight. For example, UV damage and color fading are substantially reduced during the drying process because the cover shields the textiles from sunlight and UV radiation.

Thirdly, the invention substantially reduces the time required to air dry clothes and textiles. Due to the induced dynamic airflow within the drying rack, the increased heat and mass transfer rates cause the clothes and textiles to dry in a more expedient manner and correspondingly reduce the time required to sufficiently dry the items. Additionally, as result of the dynamic airflow and increased heat/mass transfer rates, clothes and textiles dried in the drying rack of the present invention are left soft and supple to the touch after the drying is complete.

Finally, the invention is well suited for eliminating the unpleasant visual appearance of air drying clothes and textiles because the items being dried are substantially shielded from public view by the wrap-around cover. Consequently, a person may avoid potential fines and penalties from governing organizations, such as homeowners associations, with the use of the present invention.

Although the above provides a full and complete disclosure of the preferred embodiments of the invention, various modifications, alternate constructions and equivalents will occur to those skilled in the art. For example, the support frame may be configured as a hanging frame that permits the drying rack to be suspended from the ceiling. Additionally, the support frame may be configured as a wall mounted unit having a plurality of shelves coupled to a wall. Therefore, the disclosure should not be construed as limiting the invention, which is defined by the claims.

What is claimed:

1. A drying rack for drying clothes comprising: a support frame comprising at least one support member, said at least one support member having a first end and an opposing second end;

an air exhaust defined by an upper shelf, said air exhaust having a cross-sectional area said upper shelf pivotally coupled to said at least one support member adjacent an upper portion of said drying rack, said upper portion substantially adjacent said second end;

an air intake defined by a lower shelf, said air intake having a cross-sectional area such that said air intake is larger in cross-sectional area than said air exhaust, said lower shelf pivotally coupled to said at least one support member adjacent a lower portion of said drying rack, said lower portion substantially adjacent said first end, said lower shelf spaced apart from said upper shelf;

at least one intermediate shelf pivotally coupled to said at least one support member and positioned between said upper shelf and said lower shelf; and a cover fabricated from a heat absorptive high density polyethylene plastic fabric, said cover having a top edge, an opposing bottom edge, an outwardly facing surface and an opposing inwardly facing surface, said top edge releasably coupled to a perimeter edge of said upper shelf and said bottom edge positioned adjacent to said lower shelf, wherein an internal volumetric space is defined by said inwardly facing surface as said cover wraps-around said drying rack such that said internal volumetric space is heated by said cover resulting in an induced dynamic airflow within said internal volumetric space in order to dry the clothes, said induced dynamic airflow facilitated by said air exhaust having a smaller cross-sectional area than said cross-sectional area of said air intake such that said induced dynamic airflow is accelerated from said air intake towards said air exhaust;

wherein the cover protects the clothes from fading and UV damage by shielding the clothes from direct sunlight.

2. A drying rack in accordance with claim 1, wherein said upper shelf, said lower shelf and said at least one intermediate shelf each further comprise a plurality of spaced-apart shelf slats that extend across a width of each respective shelf.

3. A drying rack in accordance with claim 1, further comprising at least one vertical rack having a plurality of slats, said at least one vertical rack pivotally coupled to said at least one intermediate shelf such that said at least one vertical rack extends between said at least one intermediate shelf and said upper shelf.

4. A drying rack in accordance with claim 1, further comprising at least one vertical rack having a plurality of slats, said at least one vertical rack pivotally coupled to said lower shelf such that said at least one vertical rack extends between said lower shelf and said at least one intermediate shelf.

5. A drying rack in accordance with claim 1, wherein said outwardly facing surface of said cover has a graphic design thereon.

6. A drying rack in accordance with claim 1, wherein said bottom edge of said cover extends below said lower shelf.

7. A drying rack in accordance with claim 1, wherein said support frame is configured for anchoring to a ground surface.

8. A drying rack in accordance with claim 1, wherein said support frame is configured to expand from a collapsed state to an expanded state, wherein when said support frame is in said collapsed state said upper shelf, said at least one intermediate shelf and said lower shelf are substantially co-planer.

9. A drying system for drying clothes comprising:

a drying rack having a support frame comprising at least one support member, said at least one support member having a first end and an opposing second end, an air exhaust defined by an upper shelf, said air exhaust having a cross-sectional area, said upper shelf pivotally coupled to said at least one support member adjacent an upper portion of said drying rack, said upper portion substantially adjacent said second end, an air intake defined by a lower shelf, said air intake having a cross-sectional area such that said air intake is larger in cross-sectional area than said air exhaust, said lower shelf pivotally coupled to said at least one support member adjacent a lower portion of said drying rack, said lower portion substantially adjacent said first end, said lower shelf spaced apart from said upper shelf, at least one intermediate shelf pivotally coupled to said at least one support member and positioned between said upper shelf and said lower shelf; and a cover fabricated from a heat absorptive high density polyethylene plastic fabric, said cover having a top edge, an opposing bottom edge, an outwardly facing surface and an opposing inwardly facing surface, said top edge releasably coupled to a perimeter edge of said upper shelf and said bottom edge positioned adjacent to said lower shelf, wherein an internal volumetric space is defined by said inwardly facing surface as said cover wraps-around said drying rack such that said internal volumetric space is heated by said cover resulting in an induced dynamic airflow within said internal volumetric space in order to dry clothes, said induced dynamic airflow facilitated by said air exhaust having a smaller cross-sectional area than said cross-sectional area of said air intake such that said induced dynamic airflow is accelerated from said air intake towards said air exhaust; wherein the cover protects the clothes from fading and UV damage by shielding the clothes from direct sunlight.

10. A drying system in accordance with claim 9, wherein said upper shelf, said lower shelf and said at least one intermediate shelf each further comprise a plurality of spaced-apart shelf slats that extend across a width of each respective shelf.

11. A drying system in accordance with claim 9, further comprising at least one vertical rack having a plurality of slats, said at least one vertical rack pivotally coupled to said at least one intermediate shelf such that said at least one vertical rack extends between said at least one intermediate shelf and said upper shelf.

12. A drying system in accordance with claim 9, further comprising at least one vertical rack having a plurality of slats, said at least one vertical rack pivotally coupled to said lower shelf such that said at least one vertical rack extends between said lower shelf and said at least one intermediate shelf.

13. A drying system in accordance with claim 9, wherein said outwardly facing surface of said cover has a graphic design thereon.

14. A drying system in accordance with claim 9, wherein said bottom edge of said cover extends below said lower shelf.

15. A drying system in accordance with claim 9, wherein said support frame is configured for anchoring to a ground surface.

16. A drying system in accordance with claim 9, wherein said support frame is configured to expand from a collapsed state to an expanded state, wherein when said support frame is in said collapsed state said upper shelf, said at least one intermediate shelf and said lower shelf are substantially co-planer.

17. A drying rack comprising: a support frame comprising at least one support member, said at least one support member having a first end and an opposing second end; an upper shelf pivotally coupled to said at least one support member adjacent an upper portion of said drying rack, said upper portion substantially adjacent to said second end; said upper shelf having a cross sectional area a lower shelf pivotally coupled to said at least one support member adjacent a lower portion of said drying rack, said lower portion substantially adjacent said first end, said lower shelf spaced apart from said upper shelf; said lower shelf having a cross sectional area that is larger than the cross sectional area of the upper shelf, at least one intermediate shelf pivotally coupled to said at least one support member and positioned between said upper shelf and said lower shelf; at least one vertical rack having a plurality of slats, said at least one vertical rack pivotally coupled to said at least one intermediate shelf such that said at least one vertical rack extends between said at least one intermediate shelf and said upper shelf;

and a cover having a top edge, an opposing bottom edge, an outwardly facing surface and an opposing inwardly facing surface, said top edge releasably coupled to a perimeter edge of said upper shelf and said bottom edge positioned adjacent to said lower shelf, wherein an internal volumetric space is defined by said inwardly facing surface as said cover wraps-around said drying rack; wherein the cover protects the clothes from fading and UV damage by shielding the clothes from direct sunlight.

18. A drying rack in accordance with claim 17, further comprising two vertical racks having a plurality of slats, wherein a second vertical rack of said two vertical racks is pivotally coupled to said lower shelf such that said second vertical rack extends between said lower shelf and said at least one intermediate shelf.

19. A drying rack in accordance with claim 17, wherein said cover is fabricated from a heat absorptive high density polyethylene plastic fabric.

20. A drying rack in accordance with claim 17, wherein the cross-sectional area of said upper shelf defines an air exhaust and the cross-sectional area of said lower shelf defines an air intake, wherein said air intake is larger in cross-sectional area than said air exhaust.

* * * * *